United States Patent [19]

Bingham

[11] 4,206,947

[45] Jun. 10, 1980

[54] PERCUSSIVE SLOT CUTTER

[75] Inventor: Henry Bingham, Springs, South Africa

[73] Assignee: Boart Hardmetals (Proprietary) Limited, Springs, South Africa

[21] Appl. No.: 963,564

[22] Filed: Nov. 20, 1978

Related U.S. Application Data

[63] Continuation-in-part of Ser. No. 541,195, Jan. 15, 1975, abandoned.

[30] Foreign Application Priority Data

Jan. 18, 1974 [ZA] South Africa ..... 74/0384
Mar. 7, 1974 [ZA] South Africa ..... 74/1475

[51] Int. Cl.[2] ..... E21C 27/02
[52] U.S. Cl. ..... 299/10; 299/70
[58] Field of Search ..... 299/61, 70, 10, 38

[56] References Cited

U.S. PATENT DOCUMENTS 2,398,311 4/1946 Hulshizer ..... 299/70 X

*Primary Examiner*—William F. Pate, III
*Attorney, Agent, or Firm*—Cushman, Darby & Cushman

[57] ABSTRACT

A machine for cutting a slot in hard rock uses a percussive drill to slot the rock, the drill being so mounted that the tool has an obtuse angle to the base of the slot in the direction of advance, which angle is for optimum effect between 120° and 145° and preferably between 130° and 140°. The drill is oscillated and cuts on the forward stroke and free wheels on the return stroke. The drill may be adjusted to vary the angle and the angle of inclination to the horizontal.

1 Claim, 5 Drawing Figures

PERCUSSIVE SLOT CUTTER

Figure 1:
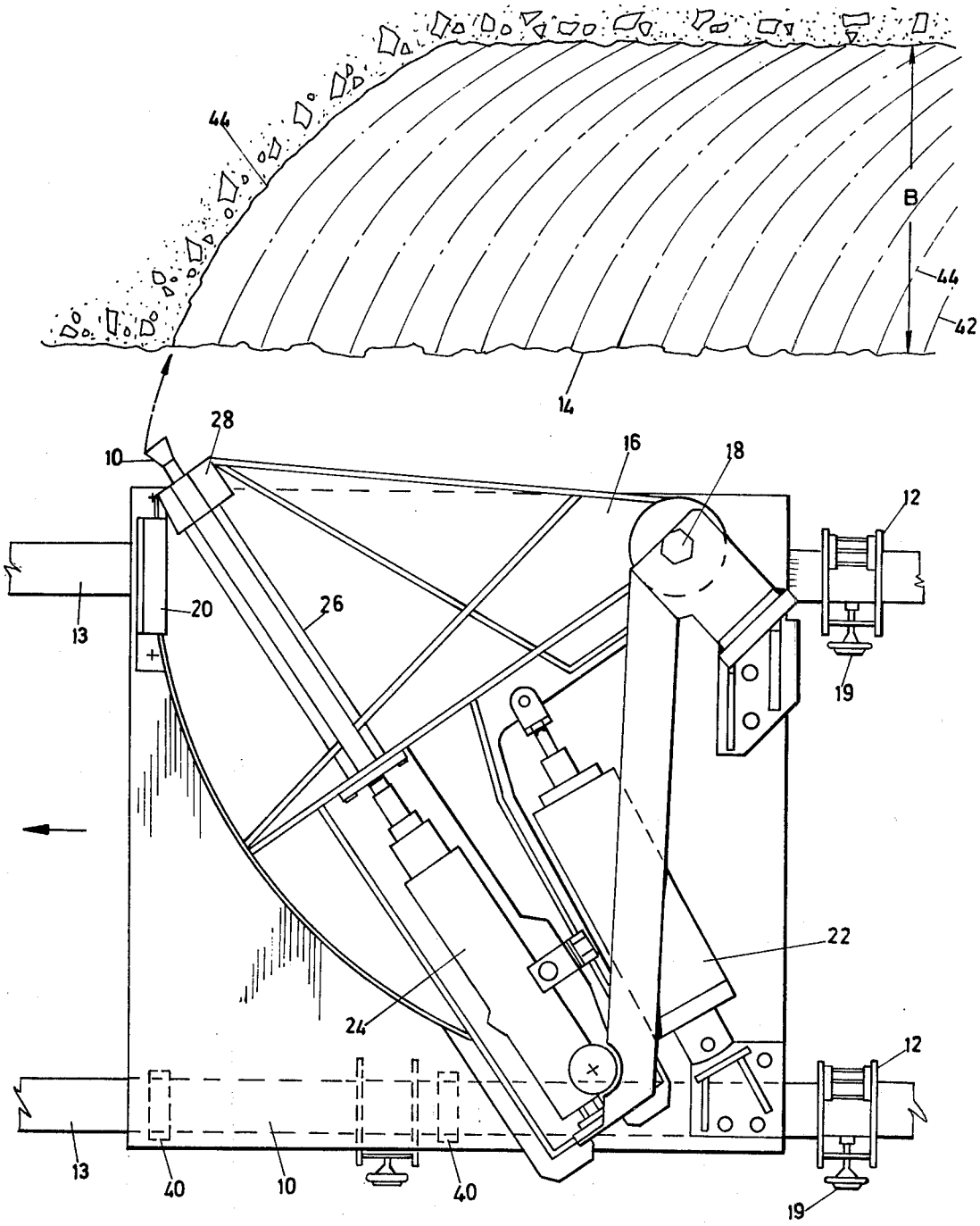

This application is a continuation-in-part application of application Ser. No. 541,195 filed by me on Jan. 15, 1975, and now abandoned.

BACKGROUND TO THE INVENTION

Skyrocketting costs and labour shortages are making it more and more urgent that a method of hard-rock mining alternative to the present drilling and blasting procedure be evolved. By "hard-rock" mining is meant the mining of rock such as is encountered in gold mining on the Witwatersrand in the Republic of South Africa and the gabbro complex at Duluth in the State of Minnesota, both of which have a hardness of the order of 7 on the Moh's scale. The most promising alternative appears to be rock-cutting or slotting, in which the reef is isolated from the waste rock, as much as is possible, by slots cut into the rock face, which cause or allow the reef and the waste to be separately detached and removed. There may be two slots, straddling the reef, producing such instability in the waste rock above the reef that the rock disintegrates or can be made to disintegrate, leaving the reef, itself made unstable by the slotting, to be separately detached and recovered for processing. In other cases, a single slot may suffice.

Techniques of this kind are known and have been successfully employed for mining soft materials such as coal, which has a hardness of the order of 3 on the Moh's scale. But mining hard rock of this nature poses massive problems not encountered in the mining of soft material such as coal so that technology evolved for mining such soft material successfully is so little helpful when dealing with the mining of hard rock as, in effect, to constitute a different art.

Two cutting methods of slotting hard rock are currently under development: one in which the slot is made by scraping a blade along the face and progressively deepening the slot at each traverse, until the maximum practical depth has been achieved. The other, and it is to this category that the present invention belongs, makes the slot by means of a percussive drill that is caused to traverse the face and progressively increase the depth of slot. This latter method has the attraction that the maximum depth of the slot is not dictated by the strength of the structure supporting the cutting elements, as in the former case, but by the length of the drill tool.

Two methods of percussive slot cutting have been proposed, each using a conventional rock drilling machine mounted to be traversed along the face. In one, the movement of the machine is rectilinear, in the other the path is arcuate. The present invention is applicable to both.

In the known slotting equipment, the rock drill is so mounted on its support that the drill tool is perpendicular to the general plane of the face. This arrangement imports disadvantages, which will be considered later, and which it is the purpose of the invention to minimise.

There is also known a rock slotting equipment disclosed in U.S. Pat. No. 2,398,311 to George W. Hulshizer, in which a percussive rock drill traverses the face of the material to be cut on an arcuate oscillating path, the drill axis being inclined to the tangent of the slot being cut at an angle, in the direction of advance of the drill, of about 105°. The cutting operation proceeds on both the forward and the return strokes of the drill which is feasible owing to the fact that the machine is intended for operation in coal and like deposits, which are soft. The machine could not be operated in hard rock because, on the return stroke, the drill would not, owing to its acute angle to the tangent of the slot in the direction of movement of the drill, be capable of making a cut and would, in all probability, be damaged, as it juddered back to its initial position, and could also jam in the slot.

THE INVENTION

According to the invention, an improved method of operating a rock drill having an elongated drilling tool to cut a slot in hard rock by balancing the forces acting against the drilling tool to prolong the operating life thereof, comprises the steps of traversing the drilling tool in rock-cutting engagement with the hard rock to be cut, the drilling tool having an obtuse angle of attack to the base of the slot being cut in the rock in the direction of the advance of the machine, the forces acting transverse to the longitudinal axis of the elongated drilling tool being thereby in substantial balance, and returning the drilling tool to its initial rock cutting-position without being in rock-cutting engagement with the hard rock.

Further according to the invention, the angle of the tool may be varied to suit differing conditions and, for optimum effect, is in the range 120° to 145° and preferably between 130° and 140°.

DESCRIPTION OF THE INVENTION

Figure 2:
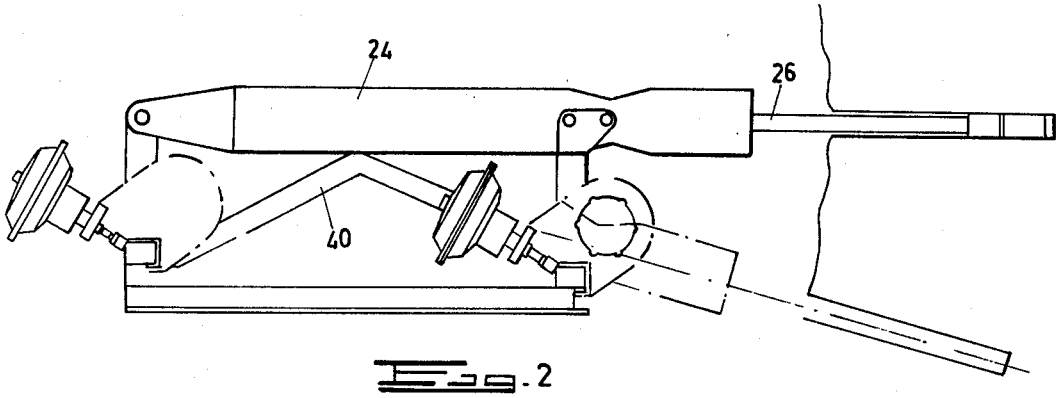
Figure 3:
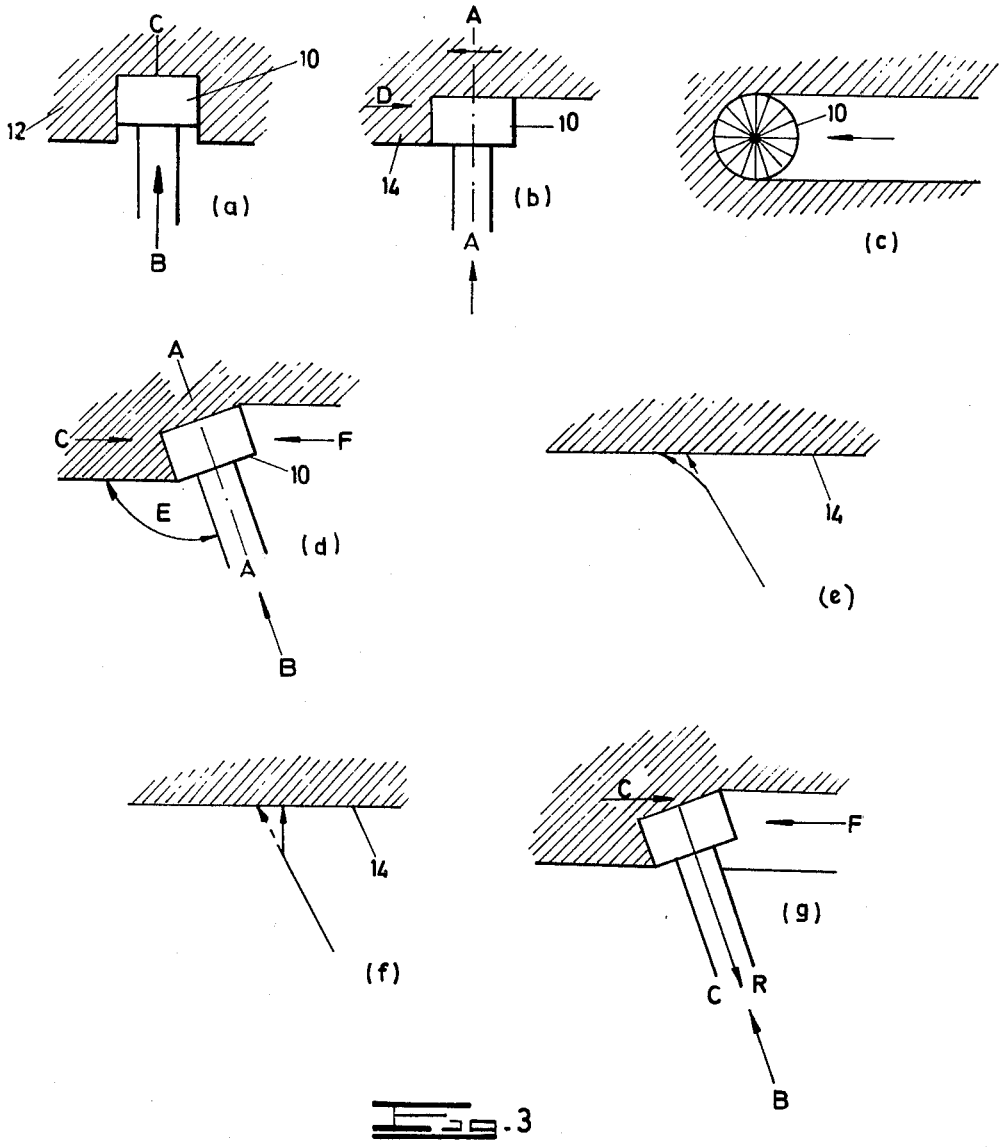
Figure 4:
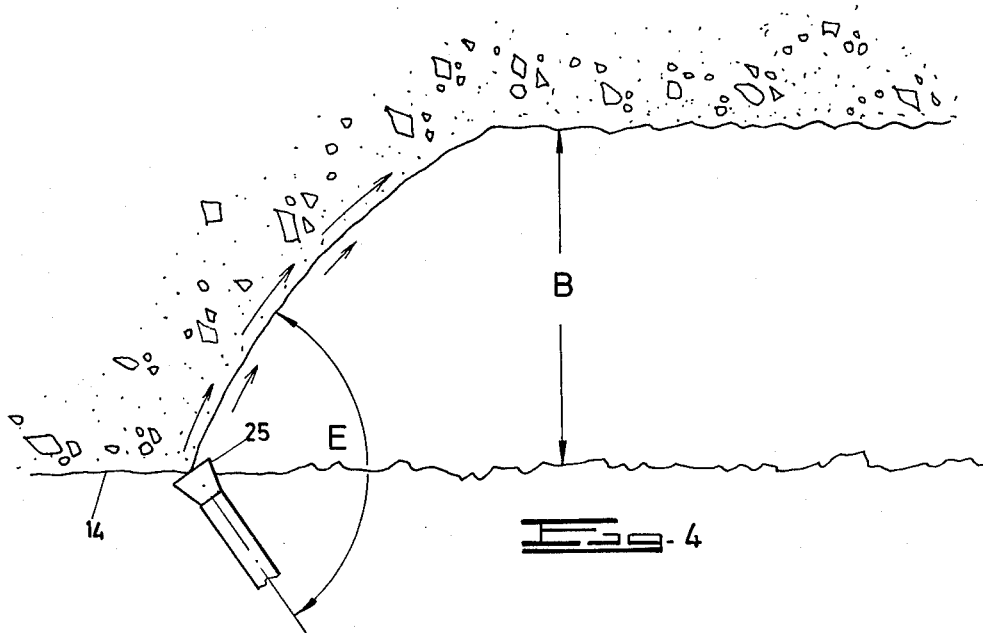
Figure 5:
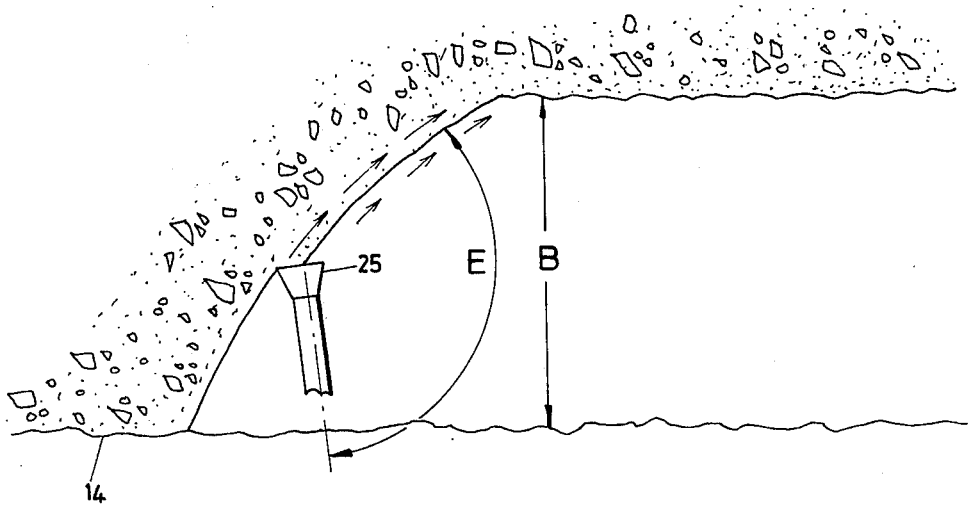

An embodiment of the invention is illustrated in the accompanying drawings in which:

FIG. 1 is a diagrammatic plan view of rock-cutting machine according to the invention, FIG. 2 is a side view of part of the machine, FIG. 3 is a series of sketches showing the forces acting on the cutting bit of a rock drilling machine, FIG. 4 is a diagrammatic view of the cutting bit about to commence a cutting stroke, and FIG. 5 is the same view but with the cut partly made.

Consider first the diagrams in FIG. 3. In (a), the drill bit 10 is being used conventionally, that is to say to advance axially into the rock 12. The thrust B applied to the bit by the drill acts along the axis of the bit and the reactive force C applied by the rock to the bit is also axial, so that the system is in balance as long as the hole remains straight. In (b), the axis of the bit is still normal to the general plane of the rock face 14, but the bit is traversed along the face to cut the slot. As is seen in FIG. 3(*c*), only about half of the periphery of the bit is in contact with the rock in the direction of advance. The reactive force D applied by the rock to the bit is normal to the axis A—A and is unbalanced, since the thrust B applied to the bit is applied along the axis A—A. The force D thus tends to bend the drill tool, and, as the tool is rotating, the metal of which it is made is continuously passing from a state of compression to a state of tension, which causes fatigue and eventual breakage.

In FIG. 3(*d*), the tool is shown as so inclined to the general plane of the rock face that the axis A—A is at an obtuse angle E with the plane of the face, in the direction of advance of the bit along the face. As the thrust is still along the axis A—A, the reactive force C of the rock on the bit is counteracted by a force F, which is a component of the thrust force B, and, if the angle of attack E is so correlated with the various parameters—the bit diameter, the magnitude of the thrust force B, (which will include a component of force in the direction of the axis of the tool when the tool is indexed along a prescribed rectilinear or arcuate path, due to the force applied to the tool to move it along that path,) the rate of advance of the bit, and the kind of rock being cut—the forces C and F will be substantially in balance and no bending of the drill tool will occur. In the correlation, the nature of the rock being cut and the rate of cut, or the indexing interval, that is to say the distance that the drilling machine is advanced at the end of each cut to enable the next cut to be made, are of paramount importance. If the index distance is too small, the rock fractures ahead of the bit and the force C temporarily disappears, causing the bit to ride out of the hole, as is indicated in FIG. 3(*e*). Once this happens, it is difficult if not impossible to re-insert the bit into the slot. If, on the other hand, the index distance is too great, the bit tends to jam in the slot, the reactive force C disappears and the force F causes the rod to bend as seen in FIG. 3(*f*). Interposed between the two conditions is FIG. 3(*g*), in which the indexing interval is correct for the conditions, and the reactive force C from the thrust force B, and the overall resultant force R are coincident and aligned with the bit axis A—A. The bit is then operating at optimum efficiency and the rate of cut economic.

It will thus be seen that the angle of attack, E, is critical. The ideal angle for the particular conditions under which cutting is taking place must of necessity be empirically established and must be adjusted if the conditions change materially. However, it can be stated generally that the angle will be of the order of 135°±5° for the overwhelming majority of conditions in the Witwatersrand gold mines and in any other mines having similar rock characteristics. Angles of attck falling outside the normal range may be found suitable when any of the variable parameters is changed.

The cutting method discussed above is applicable both to rectilinear slotting, and to arcuate slotting by a drilling machine mounted on a pivoted arm. Mechanically, the latter system is simpler than the former and it is somewhat easier to initiate the cut, and for these reasons the preferred apparatus according to the invention is of the latter type.

In the rock cutting machine shown in FIG. 1 of the drawings, a carriage 10 is mounted on shoes 12 for sliding movement along tracks 13 adjacent the rock face 14 that is to be slotted. An arm 16 is mounted on the carriage, on a pivot pin 18, for pivotal movement above and relatively to the carriage, through an arc of about 30° to 45°. The arm is supported against sag by a guide 20 on the carriage. The shoes include means to anchor the machine at a selected position on the tracks, which may be operated by airlegs 19.

The arm is shuttled back and forth by a pneumatic or hydraulic double-acting ram 22 between itself and the carriage.

The arm is constructed to carry a rockdrilling machine 24, the tool 26 of which is supported by a collar 28 mounted on the frame. The collar and the arm are smaller, in the direction normal to the plane of the frame, than the outer diameter of the bit so that collar and arm can penetrate into the slot which is being cut. The drill tool will therefore be supported by the collar throughout the slotting operation.

A means is provided to adjust the height of the arm 16 about the track, to cut a slot at any desired location on the face, and to enable the angle of the mounted drilling machine to the horizontal to be varied. The means may be a spacer bracket 40 between the frame and the track. The dimensions of the spacer to be used will depend upon the positions in the face of the slots to be cut.

For certain mining conditions, it is desirable to cut in the opposite direction from normal, in other words counterclockwise instead of clockwise. If this is necessary, the arm 16 is replaceable with one adapted to cut in the opposite direction. The method of indexing and clamping, and the adjustment of the angle of attack and the angle of dip operate equally effectively in either direction.

The rock drill is so mounted that the angle of attack of the drill bit 10 relatively to the rock face is obtuse in the direction of advance of the bit across the face. If the machine were one in which the path of movement of the bit was rectilinear, the angle E would be between the bit axis A—A and the flat base of the slot, and the general plane of the face, where, as in the present embodiment, the path of movement of the bit is arcuate, the angle of attack is that between the axis A—A and the tangent to the arcuate path (FIGS. 3 and 4). As explained above, the optimum angle of attack is dependent upon a number of factors, which, since one of them is the nature of the rock being cut, must necessarily be empirically established. To this end, the drill is so mounted on the arm that the angle of attack is, for optimum effect between 120° and 145° and preferably between 125° to 135°.

To enable the angle to be suitably adjusted, any one of a series of different drill mountings may be put into use. The series of mountings is also designed to enable the angle of inclination of the tool to the horizontal to be varied.

In use, the track is laid down and the machine mounted on it at the starting position, and clamped. The operating height of the arm 18 and the inclination of the drill tool, if any, are set by using the correct spacer and drill mounting, and, if the rock characteristics are not known, experimental cuts are made to enable the optimum angle of attack and the required indexing intervals to be established. The rock drill is then clamped.

Cutting the slot consists in running the rock drill and, at the same time swinging the arm 18 around the pivot 16 to cause the bit 10 to make the initial cut, labelled 42 in FIG. 1. The frame is then retracted to its starting position, the carriage unclamped from the track, then indexed the required interval, and reclamped; and a second cut 44 is made to deepen the slot. The sequence of operations is continued until the required depth of slot, B, in FIG. 3, has been achieved.

While the indexing intervals will vary according to local conditions, it can be said that, under typical Witwatersrand conditions, intervals of 0.36 bit diameter have been found to be correct. The bit used was one of 52 mm diameter.

Advantages of the machine of the invention include the ability to start a slot without the need for a free face or a preliminary drill hole, the ability to cut a smooth profile, deep slot in very hard rock, the possibility of cutting at any desired angle, in both the horizontal and vertical planes, the facility of being able to cut "right" or "left-handed," and the ability to be adapted easily to suit any conventional rock drilling machine. The machine has, in practice, proved itself to be capable of cutting a slot to a suitable depth, starting from a solid face, in about 20 minutes. To achieve this, a horizontal distance of approximately 0.7 meters, is travelled to cut a slot 0.52 meters deep.

One feature which is worth mention is that, should the reef be faulted, at some point alone a stope, the slot being cut can be discontinued and the machine readjusted suitably and a new slot cut.

The mechanical simplicity of the machine permits it to be made light in weight, so that it is easily handled and transported, and to be quickly and simply adjusted to suit stoping conditions. The use of a rock drilling machine, and preferably a standard one, means that, should there be malfunctioning or should a tool require replacement, this can be done in minutes.

I claim:

1. In a percussive hard rock drilling machine having an elongated drilling tool, an improved method of operating the machine for rock slotting by balancing the forces acting against the drilling tool to prolong the operating life thereof, comprising the steps of:

traversing the drilling tool in rock-cutting engagement with the hard rock to be cut, the drilling tool having an obtuse angle of attack in the range of 130° to 140° to the base of the slot being cut in the rock in the direction of the advance of the machine, the forces acting transverse to the longitudinal axis of the elongated drilling tool being thereby in substantial balance;

moving the drilling tool in an arc as the tool is in rock-cutting engagement with the hard rock; and returning the drilling tool to its initial rock-cutting position without being in rock-cutting engagement with the hard rock.

* * * * *